US006890007B1

(12) United States Patent
Parker

(10) Patent No.: US 6,890,007 B1
(45) Date of Patent: May 10, 2005

(54) COILED TUBING CONNECTOR AND METHOD OF MANUFACTURE

(75) Inventor: Robert Parker, Dorset (GB)

(73) Assignee: Varco I/P/, Inc., Houston, TX (US)

( * ) Notice: Subject to any disclaimer, the term of this patent is extended or adjusted under 35 U.S.C. 154(b) by 0 days.

(21) Appl. No.: 10/724,689

(22) Filed: Dec. 2, 2003

(51) Int. Cl.[7] ..... F16L 19/00
(52) U.S. Cl. ..... 285/354; 285/387; 285/389
(58) Field of Search ..... 285/354, 386, 285/387, 389, 247, 248, 249

(56) References Cited

U.S. PATENT DOCUMENTS

| | | | | | |
|---|---|---|---|---|---|
| 4,674,775 | A | * | 6/1987 | Tajima et al. | 285/330 |
| 4,801,158 | A | * | 1/1989 | Gomi | 285/52 |
| 6,099,046 | A | * | 8/2000 | Oh | 285/354 |
| 6,173,995 | B1 | * | 1/2001 | Mau | 285/55 |
| 6,435,570 | B1 | * | 8/2002 | Kato et al. | 285/334.5 |
| 6,450,541 | B1 | * | 9/2002 | Bakke | 285/2 |
| 6,460,900 | B1 | * | 10/2002 | Bakke | 285/330 |
| 2002/0050718 | A1 | * | 5/2002 | Pyron | 285/354 |
| 2003/0230893 | A1 | * | 12/2003 | Song et al. | 285/39 |
| 2004/0012198 | A1 | * | 1/2004 | Brotzell et al. | 285/249 |

* cited by examiner

*Primary Examiner*—James M. Hewitt
(74) *Attorney, Agent, or Firm*—Finnegan, Henderson, Farabow, Garrett & Dunner LLP

(57) ABSTRACT

In the field of oil drilling and other well operations there is a need for a coiled tubing connector that is quick and simple to use. There is also a need for a coiled tubing connector that is reusable. A coiled tubing connector (50) comprises a first sub (20); at least one arcuate segment (31, 32) and a second sub (40). The first sub (20) is slidable on the exterior surface of a length of unwound coiled tubing (10); and includes an internal recessed portion (21) and an engagement portion (22) adjacent to a first end thereof (26). At least one arcuate segment (31, 32) defines a protuberance (33) extending radially from an inner surface thereof. Each protuberance (33) is engagable with a corresponding circumferentially extending recess (11) in the coiled tubing (10). The second sub (40) is slidable on the exterior surface of the coiled tubing (10); and includes an engagement portion (41) adjacent to a first end thereof (42). The engagement portion (22) of the first sub (20) is engagable with the engagement portion (41) of the second sub (40) whereby in use each arcuate segment (31, 32) is retained within the internal recessed portion (21) of the first sub (20), thereby maintaining engagement of each radially extending protuberance (33) with the circumferentially extending recess (11).

9 Claims, 5 Drawing Sheets

COILED TUBING CONNECTOR AND METHOD OF MANUFACTURE

BACKGROUND OF THE INVENTION

Field of the Invention

The invention relates to a coiled tubing connector and a method of making such a connector.

Coiled tubing connectors are used for connecting coiled tubing to a tool, or to one end of a work string.

In oil drilling and other well operations, an operator uses coiled tubing for raising and lowering tools into the well bore. An operator attaches a tool/work string to the end of a reel of coiled tubing. By reeling out the coiled tubing the operator can insert the tool/work string to a desired location within the well. By retracting the coiled tubing an operator can remove the tool/work string from the well.

A coiled tubing connector may be subjected to significant tension, compression and torque forces within the well. The connector must not disconnect under these conditions.

A known type of coiled tubing connector is a so-called "external slip" connector.

This type of connector uses an arrangement of so-called "wicker" slips that grip the coiled tubing using a wedge-like action. An increase in tension results in an increase in grip.

Each wicker slip engages with the coiled tubing via a set of teeth. The holding capability of the connector relates to the "bite" of the teeth into the coiled tubing.

The wicker slips are hardened to ensure the engagement of the teeth with the coiled tubing. This excludes use of the external slip connector in certain harsh environments.

The wicker form, fit and size determine the outside diameter of the connector.

External slip connectors may be expensive and time-consuming to manufacture. Furthermore, manufacturing tolerances affect performance.

A second known type of coiled tubing connector is a so-called "external dimple" connector.

A connector of this type attaches to coiled tubing via a series of grub screws that engage pre-formed dimples in the outer surface of the tubing wall. The dimples are formed by using a tool. The tool places indents in positions corresponding to the grub screws on the connector.

The strength of the connector is limited by the shear strength of the grub screws.

A special tool is required to prepare the coiled tubing. As a consequence preparation and attachment of the connector is time-consuming.

The bore of the coiled tubing is significantly reduced in the region of the connector. Furthermore, the outside diameter of the connector is determined by the form and size of the grub screws.

Use of the connector in certain environments is restricted because of the materials from which the connector is constructed.

A further known type of coiled tubing connector is a so-called "roll-on" connector.

This type of connector includes a threaded portion that defines a plurality of pre-formed channels. The connector attaches to the internal bore of the coiled tubing via a threaded portion. An operator secures the connector to the coiled tubing by crimping the tubing onto the pre-formed channels using a crimping tool.

A disadvantage of this arrangement is that the bore of the connector is less than that of the coiled tubing.

The roll-on connector is also difficult to remove from the coiled tubing.

An "internal slip" connector is another type of known coiled tubing connector.

An operator secures this type of connector to the internal bore of the coiled tubing via a number of tapered slips.

The bore of the connector is significantly smaller than that of the coiled tubing.

A further type of known coiled tubing connector is a "dimple-on" connector.

This type of connector attaches to coiled tubing via a portion of the connector that includes mutually spaced dimples in its outer surface. An operator secures the connector to the coiled tubing by crimping the tubing into the pre-formed dimples using a crimping tool.

The bore of the connector is less than that of the coiled tubing.

In addition the dimple-on connector is sometimes difficult to remove from the coiled tubing.

SUMMARY OF THE INVENTION

According to a first aspect of the invention there is provided a coiled tubing connector comprising:

- a first, hollow sub including an internal recessed portion, and an engagement portion adjacent to a first end of the sub;
- at least one arcuate segment, with each said segment defining a protuberance extending radially from an inner surface thereof; and
- a second, hollow sub including an engagement portion adjacent to a first end thereof,
- the first sub being moveable on an exterior surface of a length of unwound coiled tubing;
- each said protuberance being engagable with a corresponding circumferentially extending recess in the coiled tubing; the second sub being moveable on the exterior surface of the coiled tubing; and
- the engagement portion of the first sub being engagable with the engagement portion of the second sub to cause in use each said arcuate segment to be retained within the internal recessed portion of the first sub to thereby maintain engagement of each said radially extending protuberance with the circumferentially extending recess in the coiled tubing.

According to a preferred embodiment of the invention, the second sub includes an internal shoulder, the internal shoulder in use abutting a first end of the coiled tubing.

Respective sides of each arcuate segment may preferably in use abut the first end of the second sub and an internal shoulder of the first sub, thereby preventing axial movement of the engaged subs relative to the or each arcuate segment.

Conveniently the engagement portion of the first sub defines a screw thread, and the engagement portion of the second sub defines a complementary screw thread.

Preferably the second sub includes a second end, the second end defining a threaded portion that permits the attachment of a tool or a work string to the connector.

In an alternative embodiment the second sub includes a second end, the second end defining an arrangement that is substantially similar to the first end, the two similar ends permitting the in-line connection of two lengths of coiled tubing.

According to a second aspect of the invention there is provided a method of making a coiled tubing connector comprising the steps of:

(a) forming at least one circumferentially extending recess in the outer surface of a length of unwound coiled tubing;

(b) locating a first, hollow sub so as moveably to surround the coiled tubing;

(c) placing one or more arcuate segments of a split ring on the outer surface of the coiled tubing whereby a protuberance extending radially from an inner surface of at least one arcuate segment engages the circumferentially extending recess;

(d) locating a second, hollow sub so as moveably to surround the coiled tubing; and (e) engaging the first and second subs together to retain each arcuate segment therebetween, thereby maintaining engagement of the or each radially extending protuberance with the circumferentially extending recess and locking the first and second subs against movement relative to the coiled tubing.

In a preferred embodiment of the method step (e) includes causing abutment of each arcuate segment against a first end of the second sub and an internal shoulder defined by the first sub, thereby preventing axial movement of the engaged subs relative to the or each arcuate segment.

Conveniently step (d) includes causing abutment of an internal shoulder defined by the second sub against the first end of the coiled tubing.

It is an advantage of the invention to provide a coiled tubing connector that only requires the use of a readily available tool to create and therefore is quick and simple to use.

It is a further advantage of the invention to provide a coiled tubing connector that is tailored to the strength of the coiled tubing and is not dependent upon the engagement of teeth for its holding capability.

Another advantage of the invention is to provide a coiled tubing connector that can be manufactured of a material that is appropriate for a particular (eg. downhole) environment; and manufactured inexpensively.

A further advantage of the invention is to provide a coiled tubing connector that is reusable.

It is a still further advantage of the invention to provide an easy, quick method of making a coiled tubing connector.

DESCRIPTION OF THE EMBODIMENTS

Figure 1:
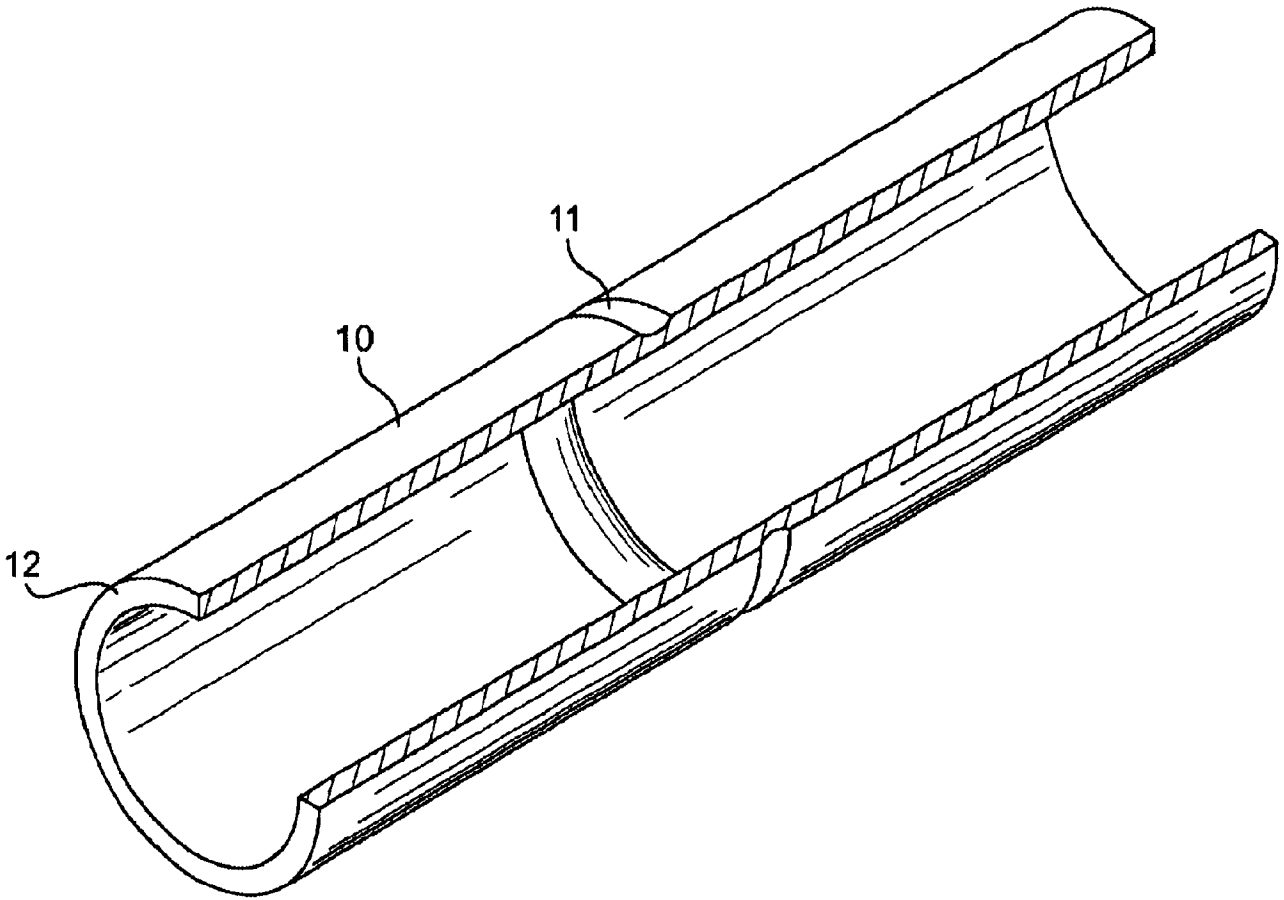
FIG. 1 PRIOR ART
FIG. 1 is a perspective, partially-sectioned view of a length of known coiled tubing unwound from its drum.

Referring to FIG. 1, a known, hollow coiled tubing for use in oil and gas wells is designated by the reference numeral 10. The coiled tubing 10 is typically formed from carbon steel, corrosion resistant alloys, or titanium; and includes a circumferentially extending recess 11 in the outer surface thereof adjacent a first end 12. In the preferred embodiment the recess 11 extends around the entire circumference of the coiled tubing 10. Other embodiments (not shown in the drawings) in which a recess or a plurality of recesses extend only part-way around the circumference of the tubing are also possible.

Figures 3, 4:
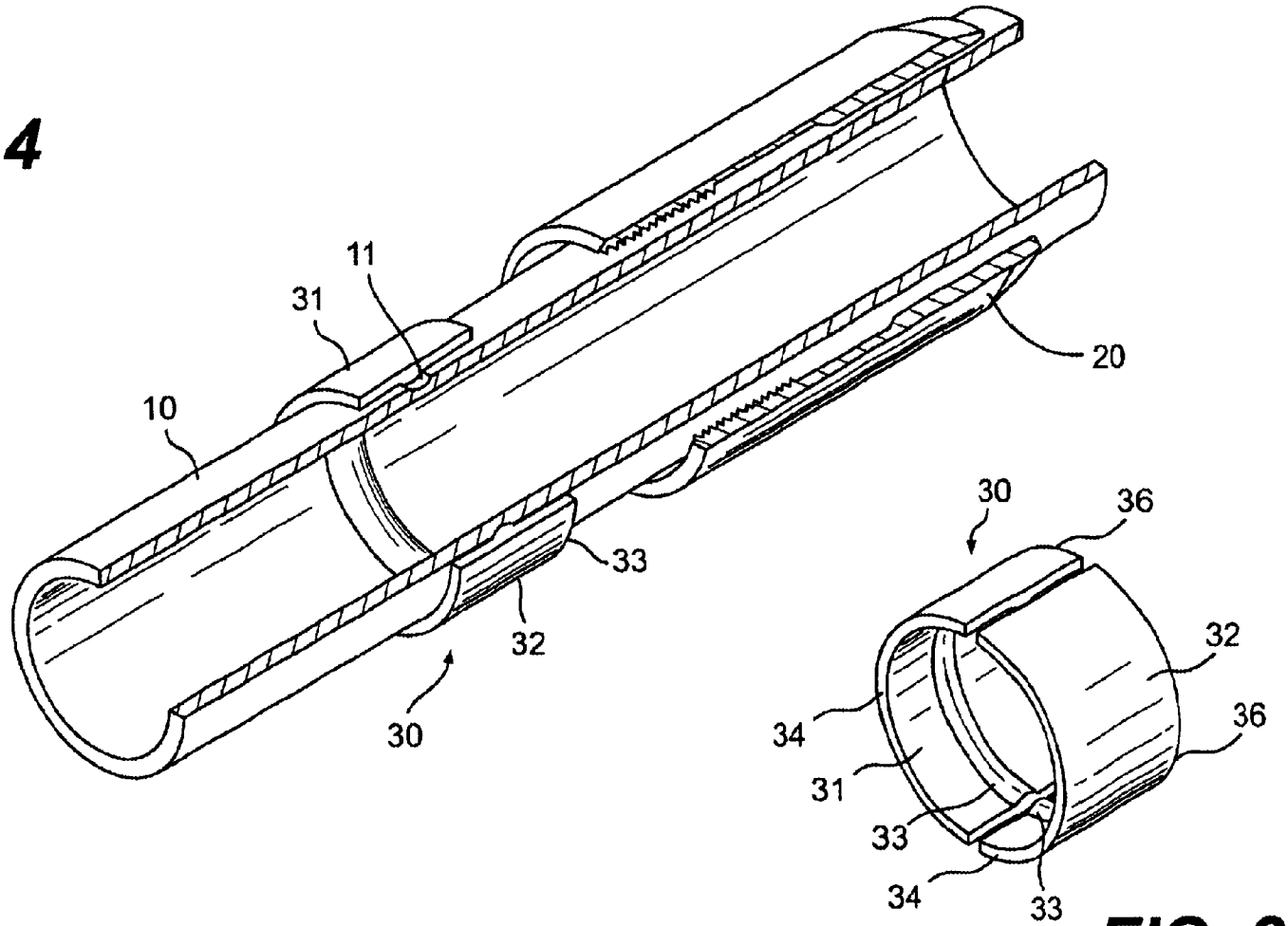
FIG. 3 is a perspective view of a split ring according to the first embodiment of the invention.
FIG. 4 is a perspective, partially-sectioned view of the FIG. 2 arrangement including the split ring according to the first embodiment of the invention.
Figure 5:
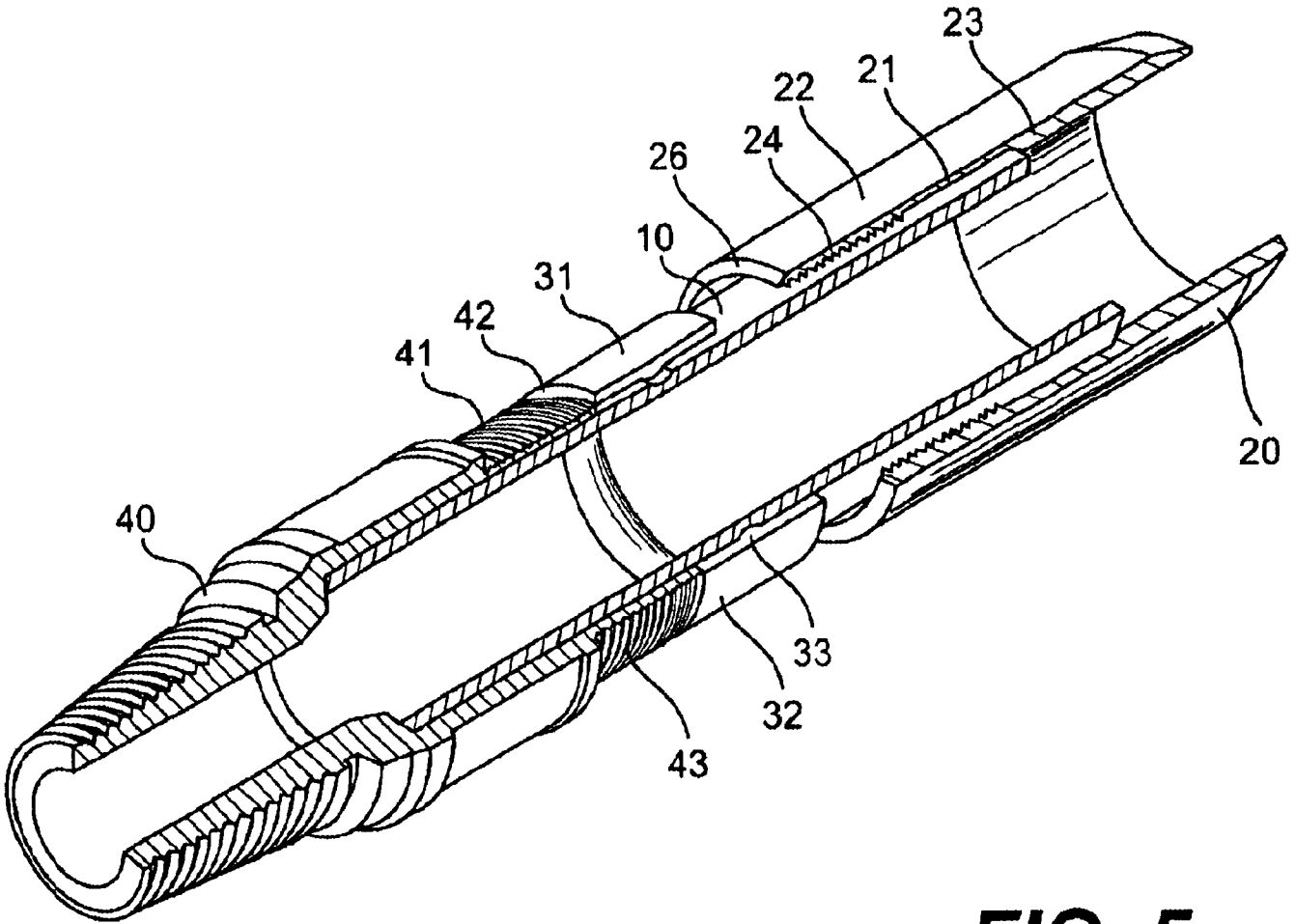
FIG. 5 is a perspective, partially-sectioned view of the first sub, the split ring, and a second sub according to the first embodiment of the invention and including the coiled tubing shown in FIG. 1.
Figure 6:
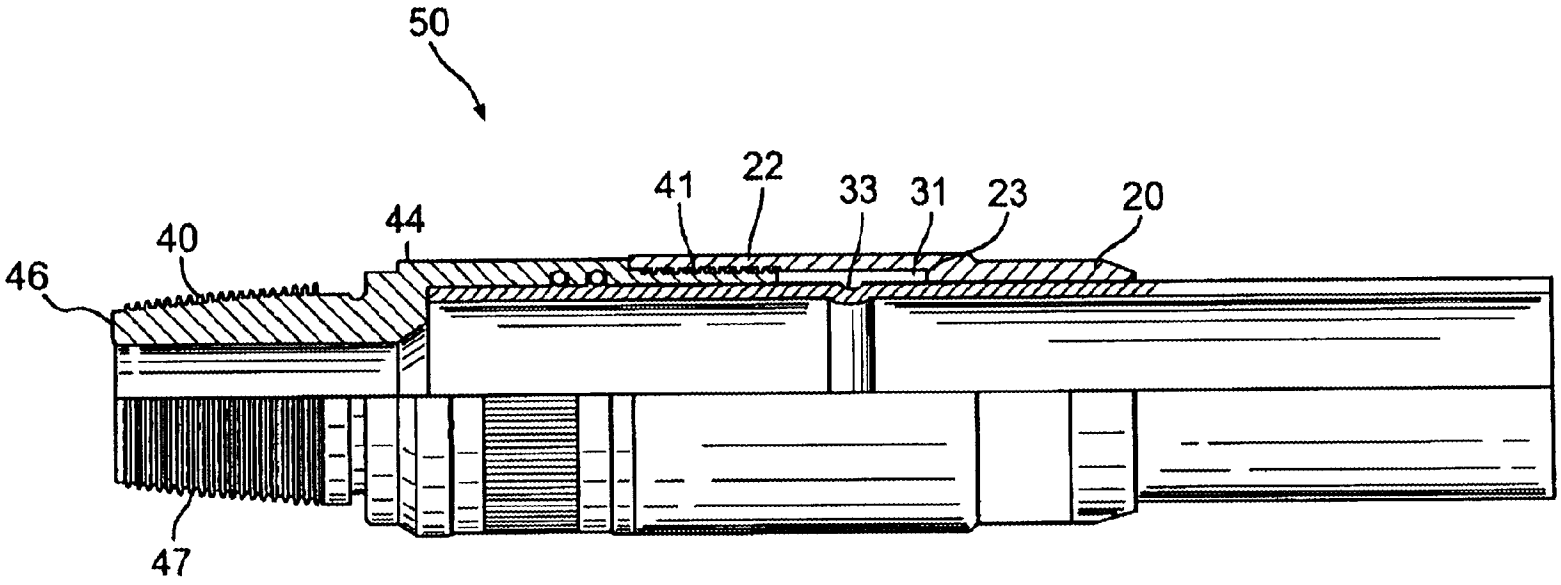
FIG. 6 is a side-elevational, partially-sectioned view of a coiled tubing connector according to the first embodiment of the invention.

Referring to FIGS. 2–6, a preferred embodiment of coiled tubing connector is designated generally by the reference numeral 50 (FIG. 6).

The connector 50 comprises a first sub 20 that is slidable on the exterior surface of the coiled tubing 10. The first sub 20 includes an internal recessed portion 21 (FIG. 2) and an engagement portion 22 at a first end 26 thereof.

The connector 50 also includes two arcuate segments 31, 32. FIG. 3 shows a preferred embodiment in which the two arcuate segments 31, 32 define a split ring 30. Each arcuate segment 31, 32 includes a protuberance 33 extending radially from an inner surface thereof.

Each protuberance 33 is engagable with the circumferentially extending recess 11 in the coiled tubing 10 (FIG. 4).

A greater or fewer number of segments may be used. Furthermore, not all of the segments need include radially extending protuberances.

The connector 50 also includes a second sub 40 that is slidable on the exterior surface of the coiled tubing 10 (FIG. 5). The second sub 40 includes an engagement portion 41 adjacent to a first end 42 thereof.

The engagement portion 22 of the first sub 20 is engagable with the engagement portion 41 of the second sub 40. Engaging the first and second subs 20, 40 together (FIG. 6) retains the two arcuate segments 31, 32 within the internal recessed portion 21 of the first sub 20. This in turn maintains engagement of the radially extending protuberances 33 with the circumferentially extending recess 11 in the coiled tubing 10.

The engagement portions 22, 41 of each of the first sub 20 and the second sub 40 define screw threads 24, 43. The second sub 40 screw thread 43 is complementary to the first sub 20 screw thread 24. This permits the first and second subs 20, 40 to engage securely together. It also facilitates the removal of the connector 50 from the coiled tubing 10, thereby allowing for the re-use of the connector 50.

In this way the connector 50 is secured to the coiled tubing 10.

The second sub 40 includes an internal shoulder 43 (FIG. 5). In use the shoulder 44 abuts a first end 12 of the coiled tubing 10. This allows the end 12 of the coiled tubing 10 to carry the axial loading on the second sub 40 as it is driven into a well bore. This removes the axial loading from the split ring 30 and recess 11, thereby extending the fatigue life of the connector 50.

Respective edges 34, 36 of the arcuate segments 31, 32 abut the first end 42 of the second sub 40 and an internal shoulder 23 of the first sub 20. This prevents axial movement of the engaged subs 20, 40 relative to the arcuate segments 31, 32. Such an arrangement also helps to extend the fatigue life of the connector 50.

A second end 46 of the second sub 40 defines a threaded portion 47 (FIG. 6). This portion 47 permits the attachment of a tool or a work string to the connector 50.

Alternatively, the second end 46 of the second sub 40 defines an arrangement (not shown in the drawings) that is substantially similar to the first end of the second sub 40. The two similar ends permit the in-line connection of two lengths of coiled tubing.

Figure 2:
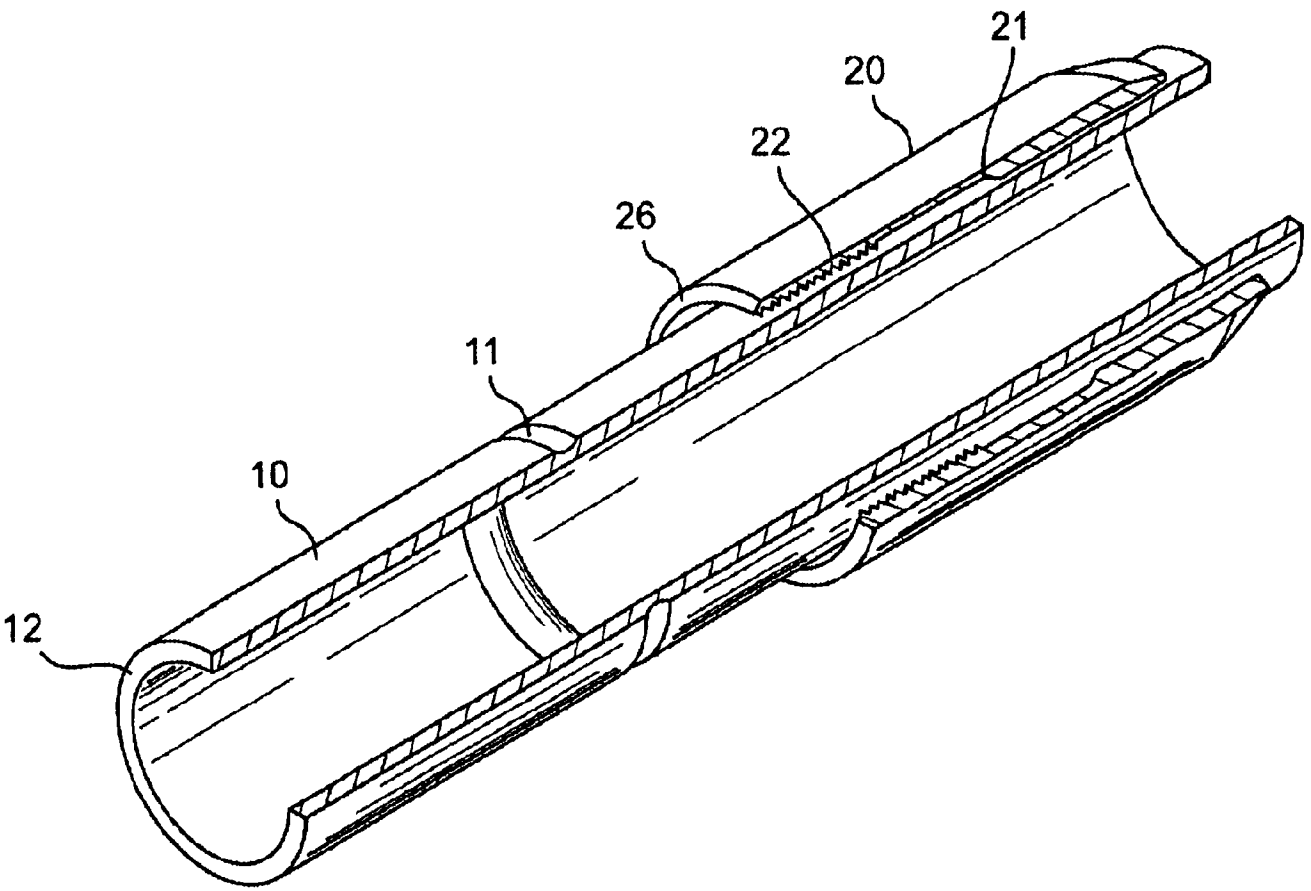
FIG. 2 is a perspective, partially-sectioned view showing a first sub according to a first embodiment of the invention positioned on the coiled tubing shown in FIG. 1.

The preferred method of making the coiled tubing connector 50 of FIG. 6 includes the following steps: forming a circumferentially extending recess 11 in the outer surface of a length of unwound coiled tubing 10; sliding a first sub 20 onto the coiled tubing 10 via first end 12 thereof (as shown in FIG. 2); placing two arcuate segments 31, 32 that define a split ring 30 on the outer surface of the coiled tubing 10 whereby a protuberance 33 extending radially from the internal surface of each arcuate segment 31, 32 engages with the circumferentially extending recess 11 (as shown in FIG. 4); sliding a second sub 40 onto the coiled tubing 10 via the first end 12 thereof, ensuring that the internal shoulder 44 defined by the second sub 40 abuts the first end 12 of the coiled tubing 10; and engaging the first and second subs 20, 40 together to retain the two arcuate segments 31, 32 therebetween, thereby maintaining engagement of each radially extending protuberance 33 with the circumferentially extending recess 11.

An operator may use a modified coiled tubing cutter to form the circumferentially extending recess 11. The cutter modification involves replacing the cutting blade with a wheel having a cross-section corresponding to the shape of recess required.

The preferred method also includes the step of causing abutment of the two arcuate segments 31, 32 against the first end 42 of the second sub 40 and the internal shoulder 23 defined by the first sub 20. This prevents axial movement of the engaged subs 20, 40 relative to the two arcuate segments 31, 32.

What is claimed is:

1. A coiled tubing connector comprising:

a first, hollow sub including an internal recessed portion, and an engagement portion adjacent to a first end of the sub;

at least one arcuate segment, each said segment defining a protuberance extending radially from an inner surface thereof;

a second, hollow sub including an engagement portion adjacent to a first end thereof;

the first sub being moveable on an exterior surface of a length of unwound coiled tubing;

each said protuberance being engagable with a corresponding circumferentially extending recess in the coiled tubing;

the second sub being moveable on said exterior surface of the coiled tubing; and the engagement portion of the first sub being engagable with the engagement portion of the second sub to cause in use each said arcuate segment to be retained within the internal recessed portion of the first sub to thereby maintain engagement of each said radially extending protuberance with the circumferentially extending recess in the coiled tubing.

2. A coiled tubing connector according to claim 1, wherein the second sub includes an internal shoulder, the internal shoulder in use abutting a first end of the coiled tubing.

3. A coiled tubing connector according to claim 1, wherein respective sides of each said arcuate segment in use abut the first end of the second sub and an internal shoulder of the first sub, thereby preventing axial movement of the so engaged subs relative to each said arcuate segment.

4. A coiled tubing connector according to claim 1, wherein the engagement portion of the first sub defines a screw thread, and the engagement portion of the second sub defines a complementary screw thread.

5. A coiled tubing connector according to claim 1, wherein the second sub includes a second end, the second end defining a threaded portion that permits the attachment of a tool or a work string to the coiled tubing connector.

6. A coiled tubing connector according to claim 1, wherein the second sub includes a second end, the second end defining an arrangement substantially similar to the first end, the two similar ends permitting the in-line connection of two lengths of coiled tubing.

7. A method of making a coiled tubing connector comprising the steps of:

(a) forming at least one circumferentially extending recess in an outer surface of a length of unwound coiled tubing;

(b) locating a first, hollow sub to moveably surround the coiled tubing;

(c) placing one or more arcuate segments of a split ring on the outer surface of the coiled tubing to cause a protuberance extending radially from an inner surface of at least one said arcuate segment to engage the circumferentially extending recess;

(d) locating a second, hollow sub to moveably surround the coiled tubing; and (e) engaging the first and second subs together to retain the or each arcuate segment therebetween, thereby maintaining engagement of the or each radially extending protuberance with the circumferentially extending recess and locking the first and second subs against movement relative to the coiled tubing.

8. A method according to claim 7, wherein step (e) includes causing abutment of the or each arcuate segment against a first end of the second sub and an internal shoulder defined by the first sub, thereby preventing axial movement of the engaged subs relative to the or each arcuate segment.

9. A method according to claim 7, wherein step (d) includes causing abutment of an internal shoulder defined by the second sub against a first end of the coiled tubing.

* * * * *